United States Patent [19]

Smith, Jr.

[11] 4,162,873

[45] * Jul. 31, 1979

[54] EXTENSIBLE BOOM LIFT

[76] Inventor: Raymond E. Smith, Jr., 385 E. Greenwood, Lake Forest, Ill. 60045

[ * ] Notice: The portion of the term of this patent subsequent to Jan. 31, 1995, has been disclaimed.

[21] Appl. No.: 873,597

[22] Filed: Jan. 30, 1978

Related U.S. Application Data

[63] Continuation-in-part of Ser. No. 758,810, Jan. 12, 1977, Pat. No. 4,070,807.

[51] Int. Cl.[2] ..... E02F 3/70

[52] U.S. Cl. ..... 414/718; 182/2; 414/728

[58] Field of Search ..... 214/140, 141, 146.5, 214/148; 52/109, 111, 118, 119; 182/2

[56] References Cited

U.S. PATENT DOCUMENTS

| | | | |
|---|---|---|---|
| Re. 23,466 | 3/1952 | McElhinney et al. | 214/141 |
| 2,598,685 | 6/1952 | Greenlief | 214/146.5 X |
| 2,767,869 | 10/1956 | Miller | 214/141 |
| 3,178,046 | 4/1965 | Lull | 214/141 |
| 3,967,744 | 7/1976 | Goyarts | 214/146.5 X |
| 4,054,185 | 10/1977 | Stedman | 214/DIG. 10 |
| 4,070,807 | 1/1978 | Smith | 182/2 X |

FOREIGN PATENT DOCUMENTS

| | | | |
|---|---|---|---|
| 931939 | 8/1955 | Fed. Rep. of Germany | 214/148 |

*Primary Examiner*—L. J. Paperner

*Attorney, Agent, or Firm*—Cook, Wetzel & Egan, Ltd.

[57] ABSTRACT

A workpiece lift including a pivotable boom with a pivot end that moves horizontally as the load end of the boom is raised and lowered, allowing the load end to move along a substantially vertical line. In a preferred embodiment the load end of the boom terminates in a workpiece arm which supports a workpiece and which extends downwardly from the load end of the boom so that the workpiece may be lifted upwardly and outwardly in an arc.

16 Claims, 8 Drawing Figures

EXTENSIBLE BOOM LIFT

CROSS REFERENCE TO RELATED APPLICATION

This application is a continuation-in-part of my co-pending application Ser. No. 758,810, filed Jan. 12, 1977, now U.S. Pat. No. 4,070,807.

BACKGROUND OF THE INVENTION

This invention relates generally to lifts for elevating various types of workpieces and more particularly to a lift which has a horizontally movable pivot point.

In building construction and maintenance, mining, storage/retrieval operations and many other fields, it is often necessary to provide aerial lifts for moving equipment and/or personnel. These lifts have generally been of two types; i.e., cranes and adjustable scaffolds. Conventional cranes are capable of lifting very large loads to relatively great heights. These cranes are usually vehicular to facilitate movement to the job site. When actual lifting is performed, however, the base of the crane, or the vehicle on which it is mounted, is ordinarily fixed in position by stabilizing pads. Since most cranes consist essentially of pivotable booms, this results in the pivot point being fixed. Thus, unless the boom is extensible, as the position of the boom is varied, the load end of the boom moves in an arc toward the boom pivot end. If a load is suspended from the boom, this action will cause the load to swing toward the boom pivot end and, more importantly, toward the boom operator, thus increasing the safety hazards inherent in such operations. If the crane is being utilized to elevate workmen and/or equipment along a vertical plane, the load end necessarily moves increasingly further from said plane as the boom angle increases.

These disadvantages are often overcome by providing extensible, ordinarily telescoping, boom sections. These boom sections are ordinarily extended by power cylinders which extend to force the telescoping boom section outward. Thus, as the boom angle is increased, the power cylinder is extended by the operator thus increasing the length of the boom. This insures that the boom load end moves in a substantially vertical line. Increasing the extension of the power cylinder can extend the load end of the boom outwardly from the lift so that the load may, in the case of a skilled operator, be lifted upwardly and outwardly in an arc. However, this extensible power cylinder dramatically increases the cost of such units. Also, to insure proper, safe operations, a highly skilled operator is required and close attention is required to move the load accurately. Even with a highly skilled, attentive operator this is often a very difficult procedure since the operator's line of sight is often inadequate to provide accurate adjustments. Due to the line-of-sight problem a second operator is often placed in closer proximity to the load end. This not only increases the cost of operating the crane, but also increases safety hazards since the possibility of misunderstanding between operators is ever present. While boom mechanism may be automated to retain the load in the same vertical plane, or to move it upwardly and outwardly from the crane to a desired extent, such automation systems are quite expensive.

In lifts particularly designed to lift earth and to dump the earth into a truck, those lifts, commonly referred to as "front end loaders", are typically not capable of automatically extending their load ends horizontally far enough to dump the earth into the middle of a truck. Rather, the load end typically rises in an arc toward the lift so that the earth must be dumped near the rear or side of the truck.

Adjustable scaffolds are often utilized to move loads along a vertical plane. Scissors-type scaffolds, such as that described in my co-pending application, Ser. No. 738,599 filed Nov. 3, 1976, have been found to be advantageous. However, since such apparatuses do not provide a capability of lateral movement, they are limited in their scope of operation. If a simple, nonextensible crane were mounted on an adjustable scaffold, the reaching coverage of the apparatus is still limited, as discussed further hereinbelow and illustrated in the drawings.

Accordingly, one object of the present invention is the provision of a crane which need not have an extensible power cylinder for lengthening the boom during the lifting operation.

It is another object of the invention to provide a lift which automatically extends the boom outwardly by a known amount during the lifting operation. A further object is to provide such a lift for extending the load farther from the lift when the load is elevated than when the load is not elevated. Another object is provision of a crane which can be easily automated. Yet another object is provision of a lift which is simpler than present lifts but which has greater versatility and lifting range. It is another object of the invention to provide a lift capable of automatically lifting earth upwardly and away from the lift in an arc so that the earth may be dumped farther away from the lift than prior earth lifters are capable of. These and other objects, features, and advantages of the present invention will be apparent from the following description, appended claims, and annexed drawings.

SUMMARY OF THE INVENTION

According to this invention, a lift is provided having a boom whose pivot end moves horizontally toward a load end of the boom as the boom is elevated to keep the load end from swinging toward the lift. A support arm has one end mounted for rotation about a horizontal axis and another end pivotally mounted to the boom. Means are included for raising the support arm so that the boom pivot end moves toward the support arm during the lifting operation. The boom also includes an extensible load end which is automatically extended as the boom is raised. A workpiece arm extends downwardly from the load end of the boom for supporting a workpiece and swinging the latter upwardly and outwardly from the lift, whereby the workpiece is extended farther horizontally from the lift when in its elevated position than in its unelevated position.

The novel features which are believed to be characteristic of the invention are set forth in the appended claims. It is believed the invention will be best understood by reference to the following description taken in connection with the accompanying drawings.

DETAILED DESCRIPTION OF THE PREFERRED EMBODIMENT

Figure 1:
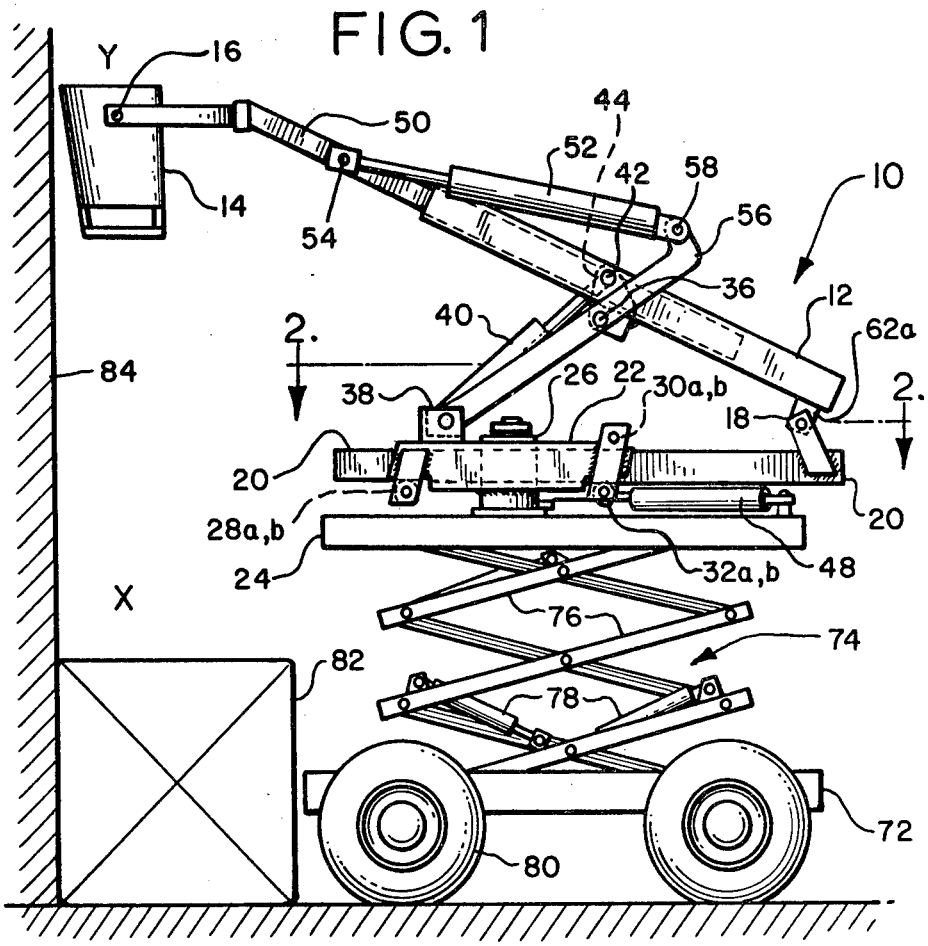
FIG. 1 is an elevation view of the invention in an intermediate position.

In that form of the invention depicted in the drawings, the aerial lift is indicated generally at 10. A pivotable boom 12 is shown to support a basket 14 which may be desired to carry a load. This load may include workmen but may alternatively or additionally include machinery of any conceivable type. In the depicted embodiment the basket 14 is allowed to rotate on pins 16 to maintain its upright position. The load end of the boom may include conventional lifting forks and automated or manual leveling mechanisms of conventional design to maintain the forks parallel to the ground. If the load is designed to be suspended from the boom, of course, no such leveling mechanism is required.

Figure 3:
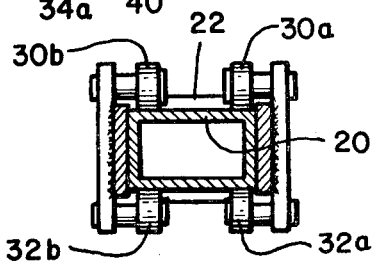
FIG. 3 is a sectional view taken along line 3—3 of FIG. 2.

The pivot end of the boom 12 is pivotally mounted at joint 18 to a sliding beam 20 which is slidably mounted in a channel which may alternatively be described either as being mounted to a mounting table 24, or as being a part of said mounting table. The channel 22 is rotatably mounted to the mounting table, or the remainder of the table, on a substantially vertical cylinder 26, to be described in more detail hereinbelow. The function of the channel 22 is to prevent axial displacement of the beam 20 with respect to the mounting table 24. Ordinarily both the beam 20 and the table 24 will be substantially horizontal as depicted, but this is not necessary for the proper operation of the apparatus. Rollers 28 *a* and *b*, 30 *a* and *b*, and 32 *a* and *b* are provided as depicted in FIG. 3 to insure that the beam 20 is slidable within the channel 22. Since a downward loading of the boom load end will tend to force clockwise axial displacement of the beam 20 with respect to cylinder 26, rollers 28 *a* and *b*, and 32 *a* and *b* will ordinarily carry most of the load.

The boom 12 is also pivotably mounted to support arms 24 *a* and *b* at joint 36. These support arms 24 *a* and *b* in turn are pivotally mounted to the channel 22 at joint 38. Thus, as the boom 12 is raised and lowered, the boom, beam, and support arm structure will pivot on joints 18, 36, and 38 to cause the beam to reciprocate with respect to the channel 22 and the mounting table 24.

Drive means for raising and lowering the boom 12 ordinarily comprises a hydraulic pivot cylinder 40 having one end pivotally mounted to the channel at a point no closer to the boom pivot end than the support arm joint 38, and the other end pivotally mounted to the boom 12 at a point remote from the support arm boom joint 36. The term "remote from" means only that the joints may not be coaxial. As depicted in the Figures, this pivot cylinder joint 42 is mounted to the boom 12 via plate 44 which is rigidly secured to the boom and which lies closer to the boom load end than does support arm joint 36. Also as depicted in the Figures, the other end of the pivot cylinder 40 is pivotally connected to the channel 22 at joint 38, coaxial with the point at which the support arm is mounted to the channel. This joint 38 will be further described hereinbelow.

While the above-described means of driving the lift is the prefered design, other means (not depicted) may alternately be utilized. For example, sliding beam 20 and rollers 18*a* and *b*, 30*a* and *b*, and 32*a* and 6 may act as a rack and pinion so that rotation of the rollers in either direction will change the lateral position of the beam 20, thus causing a change in the vertical position of the beam load end.

Figure 2:
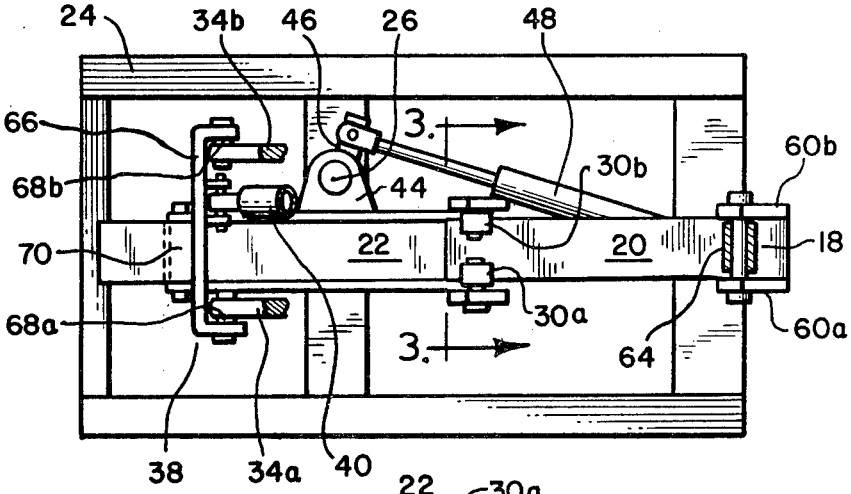
FIG. 2 is a sectional view taken along line 2—2 of FIG. 1.

As stated hereinabove, the channel 22 is rotatable with respect to the mounting table 24. This feature obviously increases the versatility of the lift to a substantial degree. The channel is rotatable on the vertical cylinder 26 which, as depicted in FIG. 2, is offset from the channel 22 and the remainder of the boom apparatus. The channel 22 is mounted on the vertical cylinder 26 by the member 44 which extends from the channel 22 and surrounds the vertical cylinder 26. Extending from member 44 is a leg 46 to which is pivotally mounted the rotational drive means, here a conventional hydraulic cylinder 48. The opposite end of this cylinder 48 is pivotally mounted to the mounting table 24.

One of the advantages of the present invention is that it allows a load to be elevated along a path which is much closer to a vertical line than do conventional booms which, when inextensible, swing the load in an arc. To provide a crane which can elevate a load along a line which is even closer to vertical, a telescoping section 50 can be added to the apparatus along with a telescoping cylinder 52. As shown one end of the telescoping cylinder 52 is pivotally attached to the telescoping section 50 at joint 54 while the other end is pivotally connected to a support arm extension 56 at joint 58. the telescoping cylinder itself need not be extensible, i.e., it may be rigid. As the boom is adjusted to various levels of inclination, the movement of the support arm extension causes the telescoping cylinder to automatically extend and retract the telescoping section of the boom. As shown in the Figures, however, the telescoping cylinder 52 ordinarily is a conventional extensible hydraulic cylinder. This provides a crane with even greater versatility.

As indicated in the Figures, the slidable beam 20 is ordinarily of rectangular configuration. The pivotable boom 12 and its telescoping section 50 are preferably also rectangular in cross section. Thus, the rollers 28*a* and *b*, 30*a* and *b*, and 32*a* and *b* are mounted on opposite sides of the slidable beam 20. Similarly, joints 18 and 36 extend across the entire cross section of the boom. Beam legs 60*a* and 60*b* extend from each side of the end portion of the beam to meet legs 62*a* and 62*b* (not visible) at pivot joint 18. A suitable bearing 64 is provided.

As shown in FIG. 2 the support arms 34*a* and *b* extend between joints 36 and 38, one on each side of the boom 12. The support arm extension 56 is ordinarily an extension of one of these arms since the telescoping cylinder 52 extends from joint 58 to only one side of the telescoping section 50 at joint 58.

As mentioned hereinabove and shown in FIG. 2, the points at which the support arms 34 and the pivot cylinder 40 are mounted to the channel 22 are preferably coaxial at joint 38. A joint plate 66 is fixed to the top of the channel and extends across the entire cross section of the slidable beam 20. This joint 38 is actually comprised of three separate joints, with the support arms 34*a* and *b* pivotable on pins 68*a* and *b*, respectively. The pivot cylinder pivots on pin 70.

The mounting table 24 to which the above-described apparatus is mounted is preferably vertically adjustable above a base 72. The means for raising and lowering the table 24 ordinarily is of scissors design, such as that described in my copending application Ser. No. 738,599, filed Nov. 3, 1976, now U.S. Pat. No. 4,088,283. This scissors mechanism shown generally at 74 includes scissors arms 76 and power cylinders 78. The base 72 is preferably provided with wheels 80 to insure mobility. Brakes (not shown) would also be desirable.

As discussed above, the boom 12 is rotatable about a vertical axis by virtue of the channel 22 being rotated by the piston 48. However, the boom 12 may also be rotated by including rotating means as described above or conventional rotating means on the base 72, and eliminating the rotating means supported by the table 24. By placing the rotating means on the base 72, the scissors mechanism 74 will be rotated along with the boom 12 and some stress to the scissors mechanism 74 may be elimianted.

Figure 4:
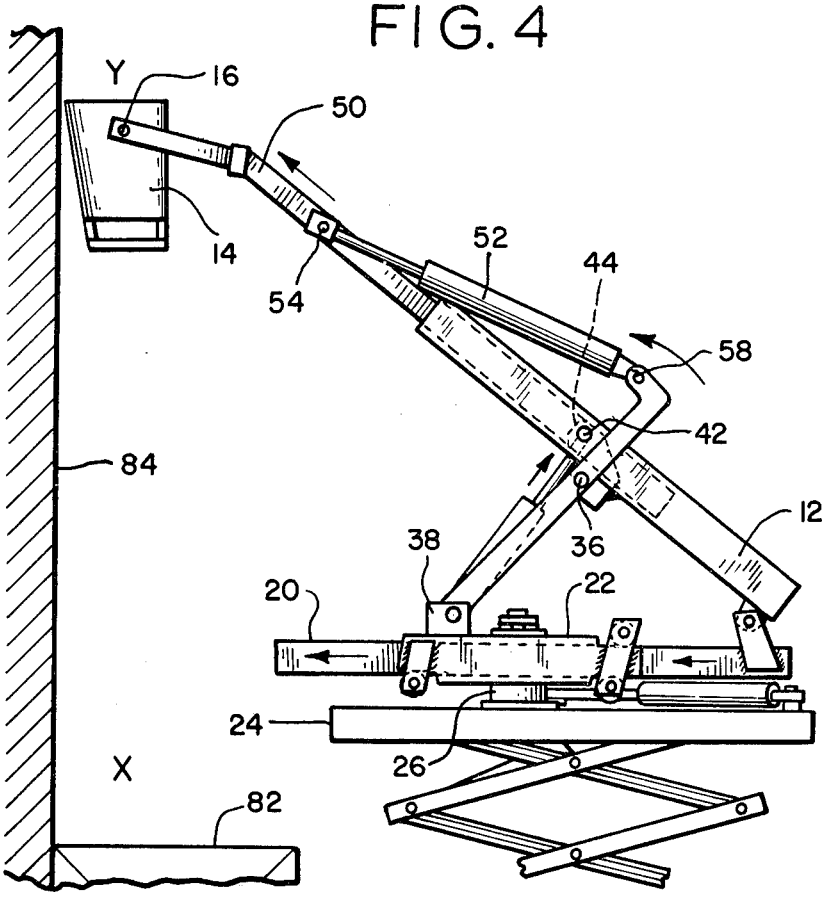
FIG. 4 is an elevation view of the invention in the fully elevated position.
Figure 5:
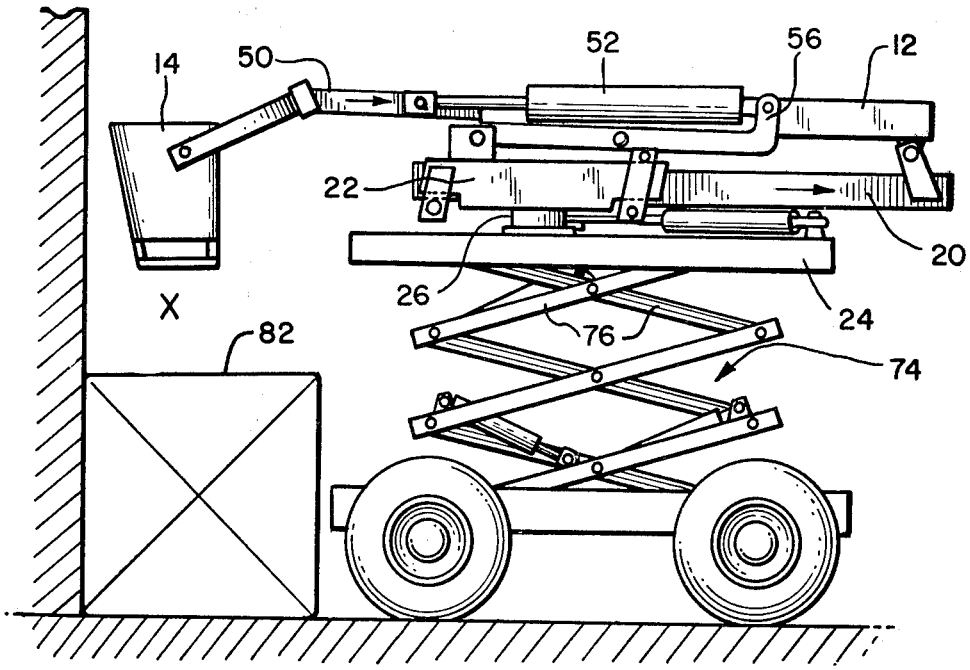
FIG. 5 is an elevation view of the invention in the fully lowered position.

In operation the above-described scissors mechanism cooperates with the pivotable boom apparatus to provide an aerial lift with greater reaching range. FIGS. 4 and 5 show the boom in lowered and raised positions, respectively, and FIG. 1 shows it in an intermediate position. A box 82 is included in these Figures to show that the aerial lift provides a reaching capability to all portions of the wall 84 with which the box 82 abuts. If the boom apparatus alone was mounted adjacent the wheels 80, the area indicated generally at X would be unreachable. Assuming the box 82 was substantially lower and the scissors mechanism 74 was fully collapsed, a conventional non-extensible boom would be unable to reach both area X and the area indicated at Y since the boom load end would necessarily move in an arc.

With the boom in the fully lowered position of FIG. 5 the pivot cylinder 40 is fully retracted and the slidable beam 20 is fully extended from the channel 22. The basket 14 is in its lowest position, nearly abutting the wall 84. To elevate the boom 12 the operator starts to extend the pivot cylinder 40, resulting in a rotational movement between joints 42 and 36. This causes joint 36 to swing upward and to the left, and the beam 20 to retract into the channel 22. The movement of the support arm extension 56 toward the boom load end causes the telescoping cylinder 52 to extend the telescoping section 50 of the boom 12, thus causing the basket 14 to elevate and remain in close proximity to the wall 84. To reach the position shown in FIG. 4, the pivot cylinder is fully extended, causing the beam 20 to fully retract through the channel 22, and causing joint 36 to swing to its uppermost position. At the same time, telescoping section 50 has become fully fixed extended. To lower the apparatus, the pivot cylinder 40 is retracted and the process is repeated. If lateral movement of the basket is desired, the boom telescoping section 50 can be further extended or retracted by activating the telescoping cylinder 52. For axial translation the rotation drive cylinder 48 is utilized. To rotate the boom apparatus in a clockwise direction with reference to FIG. 3, the rotation drive cylinder 48 is retracted and for counterclockwise rotation the cylinder is extended.

Figure 6:
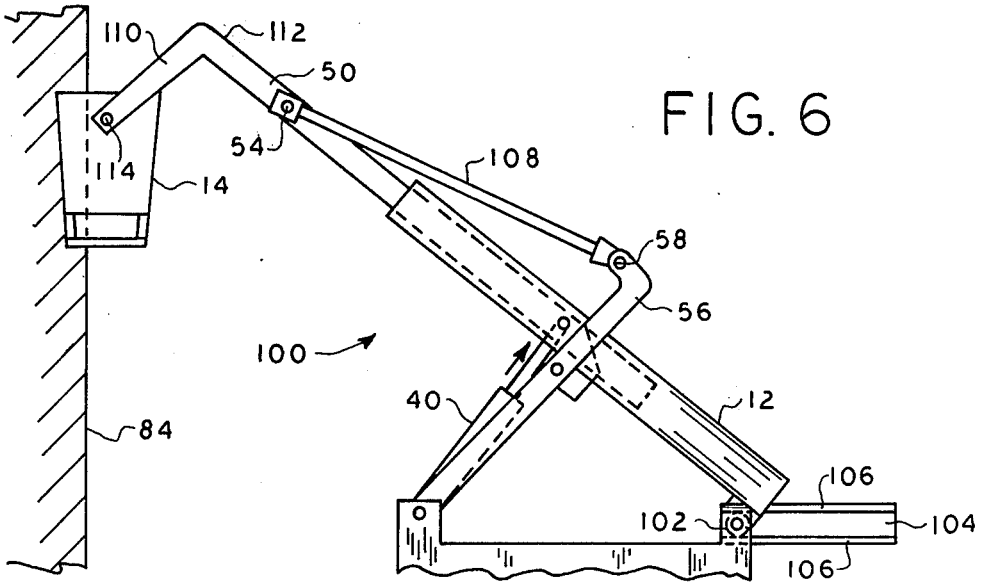
FIG. 6 is an elevation view of a lift similar to that of FIG. 1 but modified to swing a load upwardly and outwardly of the lift.

Referring now to FIG. 6, there is shown a lift 100 which incorporates many of the features of the above-described lift 10 but which is capable of lifting a workpiece such as basket 14 beyond the vertical edge of the wall 84. In this embodiment, structural elements similar to those of the lift 10 have the same reference numerals.

Specifically, the lift 100 includes a boom 12 which has a pivot end pivotally coupled to a roller 102. When the telescoping cylinder 40 is extended as shown, the pivot end of the boom 12 moves to the left in the Figure, the roller 102 being constrained to move in a groove 104 defined by a pair of tracks 106.

The elevation and telescoping of the boom 12 is as described hereinbefore with reference to the lift 10. However, the lift 100 includes an elongated rigid link 108 coupling the support arm extension 56 to the extensible or telescoping end 50 of the boom 12. The link 108 is pivotally connected at 54 and 58.

In order to cause the basket 14 to swing upwardly in an arc to the position shown in FIG. 6, a workpiece arm 110 is connected to the upper reach 112 of the extensible boom end 50 and extends downwardly therefrom as shown. Herein, the term "upper reach" is intended to define the uppermost end of the extensible boom end 50.

Near the lowermost portion of the workpiece arm 110, a pivot joint 114 connects the basket 14 to the workpiece arm 110. This preferred arrangement results in the basket 14 being supported at a location below the upper reach 112 of the extensible load end 50 of the boom 12, whereby the basket 14 is elevated in an arc such that, in its elevated position, the basket 14 is extended farther horizontally from the lift 100 than it is in its unelevated position.

As shown in FIG. 6, the workpiece arm 110 is formed integrally with the extensible load end 50 of the boom. However, they may be separate parts joined together.

In this embodiment, the extensible boom end 50 is extended by a rigid link 108. However, a telescoping cylinder may be used if further extension is desired. In addition, the embodiment of FIG. 1 may include a rigid link such as link 108 in place of the cylinder 52.

Further, the roller 102 and tracks 106 of the FIG. 6 embodiment may be replaced by the sliding channel structure of FIGS. 1 and 2, although the roller and track construction is preferred.

The lift 100 may also be supported by a scissors mechanism as shown in FIG. 1.

An advantage of having the basket 14 displaced farther horizontally from the lift 100 in its elevated position is that the basket 14 may contain material, such as earth, for example, which may be dumped farther away from the lift 100 than in the previously described embodiment. Of course, the basket 14 is but one example of a workpiece which may be suspended from the workpiece arm 110. Other types of workpieces may include conventional fork lifts, platforms, scoops, etc. Accordingly, the term "workpiece" is used herein in its broadest sense.

Figure 7:
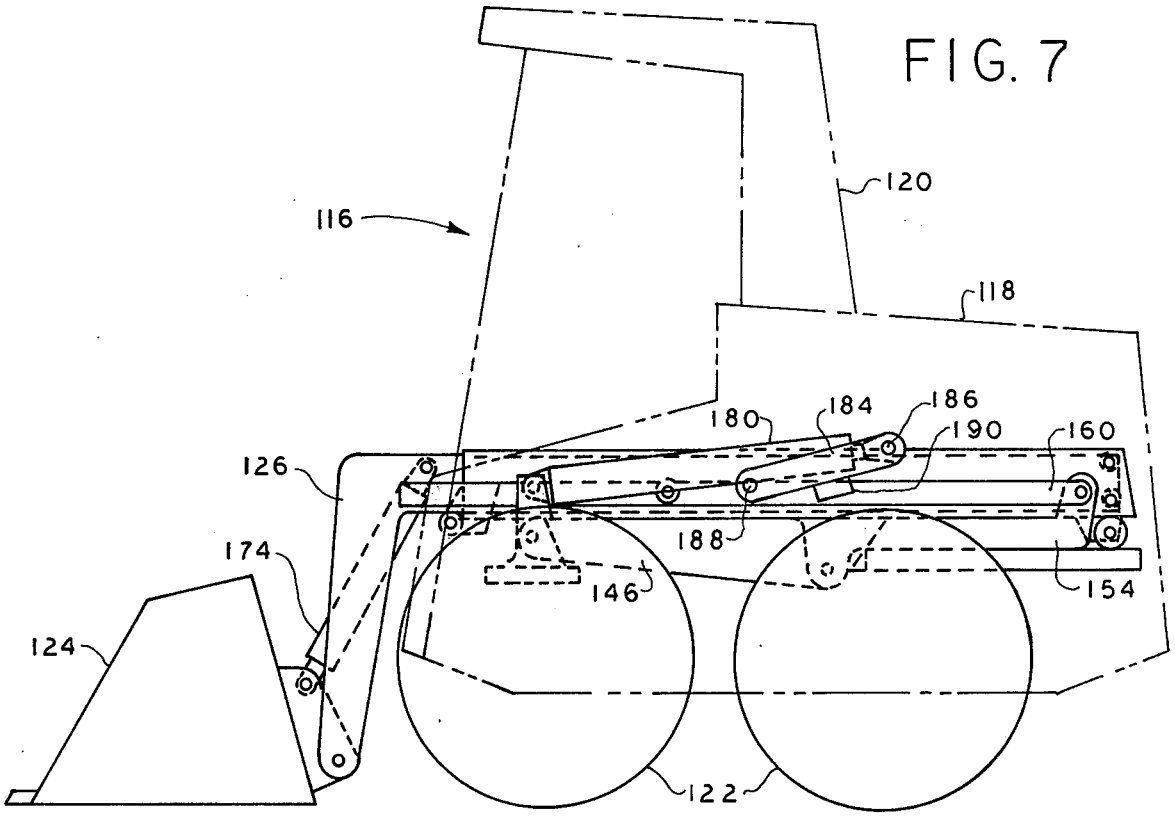
FIG. 7 is an elevation view of a lift shown particularly as an earth mover, the lift shown in an unelevated condition.

Referring now to FIG. 7, there is shown an embodiment of a lift 116 particularly constructed as a so-called front end loader for moving earth or other material. As shown, the lift 116 may include a housing 118 (shown in phantom to more clearly show the functional structure of the lift), a canopy 120 (also shown in phantom), and wheels 122. At the front end of the lift 116, a scoop 124 is mounted on a workpiece arm 126 for carrying earth or other material.

Figure 8:
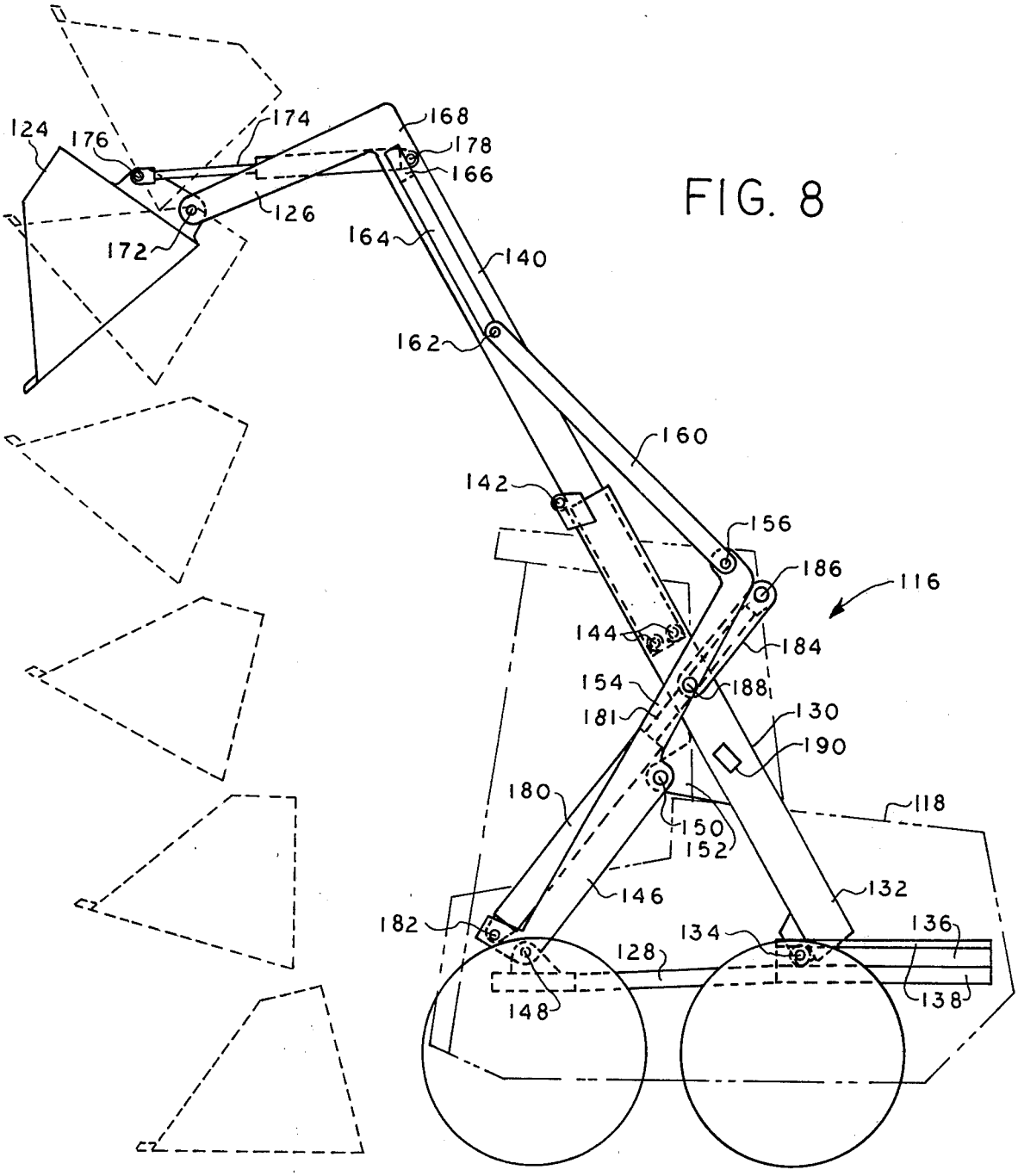
FIG. 8 is an elevation view showing the lift of FIG. 7 in an elevated condition.

The remaining structure of the lift 116 is more clearly visible in FIG. 8, to which reference is now made.

The support for the lift 116 may take the form of a base 128, as shown schematically. The base 28 may be supported within the housing 118 in any suitable manner.

Near the right end of the base 128, a boom 130 has a pivoted end 132 coupled to a roller 134, the latter of which rolls in a groove 136. The groove 136 extends horizontally between a pair of tracks 138. As the boom moves to the illustrated elevated position, the roller 134 carries the pivoted end 132 of the boom to the left in the Figure for extending the boom to the left automatically.

The boom 130 also includes an extensible load end 140 which is received into the pivot end 132 as shown. Rollers 142 and 144 assist the extensible end 140 in easily extending and retracting in the boom.

Located near the left end of the base 128 is a support arm 146 which is pivotally mounted at 148 for rotation about a substantially horizontal axis extending perpendicularly to the plane of the Figure. The support arm 146 is pivotally coupled to the pivot end 132 of the boom by a pivotal connection 150. The connection 150 is coupled to the boom pivot end 132 by a plate 152. Plate 152 may be welded or otherwise firmly connected to the boom pivot end 132.

A support arm extension 154 extends from the support arm 146 as shown beyond the boom 130. The upper end of the support arm extension 154 is pivotally connected at 156 to an elongated rigid link 160. The other end of the link 160 is pivotally connected at 162 to a bat 164. The upper end of the bar 164 is fixed to the boom load end 140 at 166.

The upper end or upper reach 168 of the boom load end 140 is coupled to a workpiece arm 126 which extends downwardly as shown from the upper reach 168. The workpiece arm 126 is shown as formed integrally with the boom load end 140 but it may also be a separate part which is fixed to the boom load end 140 in a conventional manner.

Near the lowermost end of the workpiece arm 126, the scoop 124 is attached to a pivotal connection 172 to permit the scoop 124 to be tilted about a horizontal axis through the pivotal connection 172. As shown, the pivotal connection 172 is lower than the upper reach 168 of the boom load end 140. This arrangement causes the workpiece arm 126 to raise the scoop 124 in an arc away from the lift. Thus, as shown by the various positions of the scoop 124 indicated in dashed lines, the scoop 124 is extended farther from the lift when the scoop is elevated than when it is unelevated.

In order to tilt the scoop about the axis of the pivotal connection 172, a telescoping cylinder 174 is pivotally coupled as shown to the scoop 124 at 176 and to the boom load end 140 at 178.

In order to raise the boom 130, a telescoping cylinder 180 is provided. One end of the cylinder 180 is coupled at 182 to a lower end of the support arm 146 such that the cylinder 180 is rotatable about a substantially horizontal axis substantially parallel to the axis of rotation of the support arm 146. The opposed end of the cylinder 180 is pivotally coupled to a rotatable, double-ended coupling 184, generally called a clevis. The connection between the cylinder 180 and the coupling 184 is at pivotal connection 186.

The opposed end of the coupling 184 is connected to the boom pivot end 132 at pivotal connection 188 so that the coupling 184 rotates about the pivotal connection 188 as the cylinder 180 extends.

When the cylinder 180 is retracted, the lift folds as shown in FIG. 7 and the coupling 184 comes to rest against a stop 190 protruding from the boom 130. The stop 190 is positioned on the boom as shown such that the stopping position of the coupling 184 (FIG. 7) enables the cylinder 180 to initially lift the boom with optimum torque.

As the cylinder 180 extends its rod 181 farther, the pivotal connection 186 swings upwardly about the pivot 188 to maintain the lifting torque. Eventually, the coupling 184 will swing upwardly to a position at which the centerline of the cylinder rod 181 is aligned with the centerline of coupling 184, whereupon the end of the coupling 184 which is connected at 188 will control the position of the pivotal connection 150.

As the cylinder 180 is extending its rod 181, the lifting force applied to the boom 130 causes its pivot end 132 to move to the left. In addition, the support arm 146 and its extension 154 swing upwardly and to the left, thereby urging the link 160 and the bar 164 to extend the boom load end 140. Simultaneously, the workpiece arm 126 swings the scoop 124 upwardly and outwardly of the lift 116 as shown in FIG. 8.

The horizontal extension of the scoop 124 in a direction away from the lift is also enhanced by locating the pivotal connection 156 sufficiently beyond the boom 130. In the embodiment shown in FIG. 8, the distance between the boom 130 and the pivotal connection 156 is selected to assist in the outward movement of the scoop. Further extension beyond the boom of the support arm extension 154 and pivot point 156, including a corresponding increase in the length of the link 160 to make connection to the pivot 156, further assists in extending the scoop away from the lift. Moreover, the horizontal extension of the scoop 124 away from the lift can be effected solely by increasing the length of the link 160 and the distance by which the pivotal connection extends beyond the boom. However, it is preferred to include the downwardly extending workpiece arm 126 to avoid substantially lengthening the support arm extension 154.

The lift of FIG. 8 may be modified by replacing the link 160 with a telescoping cylinder as in FIG. 1. In addition, the roller 134 and tracks 136 may be replaced by the sliding beam structure shown in FIGS. 1 and 2.

By virtue of the lift 116 automatically effecting increased horizontal extension of its scoop, its versatility is enhanced. It is particularly well suited as a so-called front end loader for lifting earth or other material and for dumping the earth into a receptacle. Such a loader can be positioned closely adjacent to a dump truck and its horizontally extended scoop can easily reach into the center of the receptacle carried by the truck.

Although the invention has been described in terms of specific exemplary structure, it will be obvious to one skilled in the art that many modifications and alterations can be made to that structure without departing from the invention. Accordingly, it is intended that all such modifications and alterations be included within the scope of the invention as defined by the appended claims.

What is claimed is:

1. A lift for raising a workpiece, comprising:

a pivotal boom having an extensible load end terminating in an upper reach and a pivot end;

means for supporting said boom so that said boom pivot end is horizontally movable but substantially vertically fixed;

a support arm having one end held from substantial horizontal motion and pivotally mounted for rotation about a substantially horizontal axis and a second end pivotally mounted to said boom;

means for raising and lowering said boom so that as said boom load end is elevated, its boom pivot end responds by moving substantially horizontally toward said support arm;

a workpiece arm extending from the load end of said boom;

means for supporting the workpiece on said workpiece arm at a location below the upper reach of the load end of said boom; and means for continuously extending said extensible load end as said load end is elevated, whereby said workpiece arm is elevated and lifts the workpiece in an arc such that the workpiece is extended farther horizontally from the lift when in its elevated position than when in its unelevated position.

2. A lift as set forth in claim 1 wherein said workpiece arm is attached to the upper reach of the load end of said boom and extends downwardly therefrom, and said means for supporting the workpiece is coupled to said workpiece arm near the lowermost portion of said workpiece arm.

3. A lift as set forth in claim 2 wherein said means for supporting the workpiece includes a pivotal coupling on said workpiece arm, and further including means for tilting the workpiece about the pivotal coupling.

4. A lift as set forth in claim 3 wherein said means for tilting the workpiece includes a telescoping cylinder coupled between the workpiece and the extensible load end of said boom.

5. A lift as set forth in claim 1 wherein said means for raising and lowering said boom includes a telescoping cylinder having one end pivotally mounted for rotation about a substantially horizontal axis substantially parallel to the axis of rotation of said support arm, and an opposed end coupled to the pivot end of said boom.

6. A lift as set forth in claim 1 wherein said support arm includes an extension which extends beyond said boom, and wherein said means for extending the load end of said boom includes an elongated, rigid link pivotally coupled at one end to said support arm extension and coupled at its other end to the extensible load end of said boom, whereby as said boom is elevated, said support arm extension pivots to urge said link to extend the extensible load end of said boom.

7. A lift for raising a workpiece, comprising:

a pivotable boom having an extensible load end terminating in an upper reach and a pivot end;

means for supporting said boom so that said boom pivot end is horizontally movable but substantially vertically fixed;

a support arm having one end pivotally mounted for rotation about a substantially horizontal axis and a second end pivotally mounted to said boom;

means for raising and lowering said boom so that as said boom load end is elevated, its boom pivot end moves substantially horizontally toward said support arm, said raising and lowering means including a telescoping cylinder having one end pivotally mounted for rotation about a substantially horizontal axis substantially parallel to the axis of rotation of said support arm, and having an opposed end;

an elongated, double-ended coupling pivotally connected at its first end to the pivot end of said boom and pivotally connected at its second end to said opposed end of said telescoping cylinder;

a workpiece arm extending from the load end of said boom;

means for supporting the workpiece on said workpiece arm at a location below the upper reach of the load end of said boom; and means for extending said extensible load end as said load end is elevated, whereby when said telescoping cylinder is actuated to telescope, said coupling rotates about its pivoted connection to the pivot end of said boom so as to optimize the lifting torque applied to said boom by said telescoping cylinder, and said workpiece arm is elevated and lifts the workpiece in an arc such that the workpiece is extended farther horizontally from the lift when in its elevated position than when in its unelevated position.

8. A lift as set forth in claim 6 further including means for stopping the rotation of said elongated coupling when said telescoping cylinder retracts to lower said boom such that said elongated coupling is stopped with respect to said telescoping cylinder so that subsequent actuation of said telescoping cylinder imparts a high level of lifting torque to said boom via said elongated coupling.

9. A lift for raising a workpiece, comprising:

a pivotable boom having an extensible load end and a pivot end;

means for supporting said boom so that said boom pivot end is horizontally movable but substantially vertically fixed;

a support arm having one end held from substantial horizontal motion and pivotally mounted for rotation about a substantially horizontal axis and a second end pivotally mounted to said boom;

an extension of said support arm which extends from the second end of said support arm to beyond said boom;

means for raising and lowering said boom so that as said boom load end is elevated, its boom pivot end responds by moving substantially horizontally toward said support arm;

a workpiece arm extending from the load end of said boom for supporting the workpiece; and elongated boom extending means coupled at one end to the extensible load end of said boom and pivotally connected at its other end to said support arm extension, the pivotal connection between said boom extending means and said support arm extension being located beyond said boom by a distance such that pivoting of said support arm and its extension causes said boom extending means to continuously extend the extensible load end of the boom and the workpiece arm such that the workpiece is lifted in an arc which places the workpiece farther horizontally from the lift when in its elevated position than when in its unelevated position.

10. A lift as set forth in claim 9 wherein said means for raising and lowering said boom includes a telescoping cylinder having one end pivotally mounted for rotation about a substantially horizotal axis substantially parallel to the axis of rotation of said support arm, and an opposed end coupled to the pivot end of said boom.

11. A lift as set forth in claim 9 wherein said boom extending means includes an elongated rigid link pivotally coupled at one end to said support arm extension and coupled at its other end to the extensible load end of said boom.

12. A lift as set forth in claim 9 wherein the load end of said boom has an upper reach, wherein said workpiece arm is attached to the upper reach of the boom load end and extends downwardly therefrom, and including means for supporting the workpiece near the lowermost portion of said workpiece arm.

13. A lift as set forth in claim 12 wherein said means for supporting the workpiece includes a pivotal coupling on said workpiece arm, and further including means for tilting the workpiece about the pivotal coupling.

14. A lift for raising a workpiece, comprising:

a pivotable boom having an extensible load end and a pivot end;

means for supporting said boom so that said boom pivot end is horizontally movable but substantially vertically fixed;

a support arm having one end pivotally mounted for rotation about a substantially horizontal axis and a second end pivotally mounted to said boom;

an extension of said support arm which extends from the second end of said support arm to beyond said boom;

means for raising and lowering said boom so that as said boom load end is elevated, its boom pivot end moves substantially horizontally toward said support arm, said means for raising and lowering said boom including a telescoping cylinder having one end pivotally mounted for rotation about a substantially horizontal axis substantially parallel to the axis of rotation of said support arm, and having an opposed end;

an elongated, double-ended coupling pivotally connected at its first end to the pivot end of said boom and pivotally connected at its second end to said opposed end of said telescoping cylinder such that when said telescoping cylinder is actuated to telescope, said coupling rotates about its pivotal connection to the pivot end of said boom so as to optimize the lifting torque applied to said boom by said telescoping cylinder;

a workpiece arm extending from the load end of said boom for supporting the workpiece; and elongated boom extending means coupled at one end to the extensible load end of said boom and pivotally connected at its other end to said support arm extension, the pivotal connection between said boom extending means and said support arm extension being located beyond said boom by a distance such that pivoting of said support arm and its extension causes said boom extending means to extend the extensible load end of the boom and the workpiece arm such that the workpiece is lifted in an arc which places the workpiece farther horizontally from the lift when in its elevated position than when in its unelevated position.

15. A lift as set forth in claim 14 further including means for stopping the rotation of said elongated coupling when said telescoping cylinder retracts to lower said boom such that said elongated coupling is stopped with respect to said telescoping cylinder so that subsequent actuation of said telescoping cylinder imparts a high level of lifting torque to said boom via said elongated coupling.

16. A lift for raising a workpiece, comprising:

a pivotal boom having an extensible load end and a pivot end;

means for supporting said boom so that said boom pivot end is horizontally movable but substantially vertically fixed;

a support arm having one end pivotally mounted for rotation about a substantially horizontal axis and a second end pivotally mounted to said boom;

a support arm extension which extends from the second end of said support arm to a position beyond said boom;

a link coupling said support arm extension to the extensible load end of said boom;

a workpiece arm coupled to the load end of said boom and extending downwardly and outwardly therefrom;

means for coupling said workpiece arm to the workpiece;

a telescoping cylinder having one end pivotally mounted adjacent said one end of said support arm for pivotal rotation about a horizontal axis, and having a second end;

an elongated, double-ended clevis coupling pivotally connected at one end to said boom and pivotally connected at its opposed end to said second end of said telescoping cylinder, whereby the telescoping of said cylinder causes said clevis coupling to rotate about its pivotal connection to said boom and to urge said boom upwardly, the pivot end of said boom moves horizontally toward said support arm, said support arm extension rotates to cause said link to extend the boom load end, and said workpiece arm lifts the workpiece upwardly in an arc away from the lift.

* * * * *